US011643847B2

(12) United States Patent
Chen

(10) Patent No.: US 11,643,847 B2
(45) Date of Patent: May 9, 2023

(54) LENGTH ADJUSTABLE DOOR LOCK

(71) Applicant: Jeff Chen, Chiayi County (TW)

(72) Inventor: Jeff Chen, Chiayi County (TW)

( * ) Notice: Subject to any disclaimer, the term of this patent is extended or adjusted under 35 U.S.C. 154(b) by 211 days.

(21) Appl. No.: 17/226,025

(22) Filed: Apr. 8, 2021

(65) Prior Publication Data

US 2022/0162885 A1 May 26, 2022

(30) Foreign Application Priority Data

Nov. 23, 2020 (TW) ..... 109215409

(51) Int. Cl.
*E05B 63/06* (2006.01)
*E05B 15/10* (2006.01)

(52) U.S. Cl.
CPC ..... *E05B 63/06* (2013.01); *E05B 15/102* (2013.01); *Y10T 292/06* (2015.04); *Y10T 292/096* (2015.04); *Y10T 292/098* (2015.04); *Y10T 292/62* (2015.04)

(58) Field of Classification Search
CPC ..... E05B 47/0012; E05B 2047/002; E05B 2047/0021; E05B 63/06; E05B 15/102; Y10T 292/0993; Y10T 292/098; Y10T 292/1018; Y10T 292/1021; Y10T 292/62; Y10T 292/06; Y10T 292/096
USPC ..... 70/461
See application file for complete search history.

(56) References Cited

U.S. PATENT DOCUMENTS 2,580,196 A * 12/1951 Schlage ..... E05B 63/18 292/169.18
3,112,944 A * 12/1963 Adler ..... E05B 55/005 292/1.5
4,602,490 A * 7/1986 Glass ..... E05B 63/06 292/DIG. 60
4,840,412 A * 6/1989 Shen ..... E05B 63/06 292/DIG. 60
4,895,404 A * 1/1990 Toledano ..... E05B 63/06 292/DIG. 60
5,149,151 A * 9/1992 Shen ..... E05B 63/06 292/DIG. 60
5,152,558 A * 10/1992 Smith ..... E05B 63/06 292/1.5
5,257,837 A * 11/1993 Bishop ..... E05B 63/06 292/DIG. 60
5,490,695 A * 2/1996 Shiue ..... E05B 63/06 292/1.5
5,529,351 A * 6/1996 Donald ..... E05B 63/127 292/191
5,613,715 A * 3/1997 Kim ..... E05B 63/06 292/1.5

(Continued)

*Primary Examiner* — Christine M Mills
*Assistant Examiner* — Faria F Ahmad
(74) *Attorney, Agent, or Firm* — Che-Yang Chen; Law Office of Michael Chen

(57) ABSTRACT

A length adjustable door lock includes a latch assembly, a lock core connected with the latch assembly, a lock bolt connected with the lock core, and a housing sleeved on the lock bolt. The latch assembly and the lock core respectively have an embedding opening and slot having matchable shape, wherein a buckling portion is formed and provided on the lock bolt coordinately, wherein the buckling portion is adapted for being assembled in the slot of the lock core through the embedding opening, which is easy for the assembling.

3 Claims, 4 Drawing Sheets

(56) References Cited

U.S. PATENT DOCUMENTS

| | | | | | |
|---|---|---|---|---|---|
| 5,647,617 | A * | 7/1997 | Kajuch | E05B 55/12 | 292/336.5 |
| 5,816,629 | A * | 10/1998 | Donald | E05B 15/102 | 292/191 |
| 5,918,916 | A * | 7/1999 | Kajuch | E05B 63/202 | 292/169.14 |
| 5,927,770 | A * | 7/1999 | Huang | E05B 15/102 | 292/169.14 |
| 6,401,297 | B1 * | 6/2002 | Huang | E05B 63/06 | 16/337 |
| 6,536,816 | B1 * | 3/2003 | Fan | E05B 63/06 | 292/1.5 |
| 2002/0008390 | A1 * | 1/2002 | Markbreit | E05B 63/06 | 292/337 |
| 2004/0004360 | A1 * | 1/2004 | Huang | E05B 63/06 | 292/337 |
| 2005/0067843 | A1 * | 3/2005 | Peng | E05B 55/005 | 292/336 |
| 2006/0208509 | A1 * | 9/2006 | Bodily | E05B 63/06 | 292/337 |
| 2008/0042452 | A1 * | 2/2008 | Moon | E05B 15/102 | 292/337 |
| 2008/0079267 | A1 * | 4/2008 | Ellis | E05C 1/163 | 292/337 |
| 2009/0064737 | A1 * | 3/2009 | Fan | E05B 63/06 | 70/169 |
| 2009/0195000 | A1 * | 8/2009 | Howey | E05C 19/163 | 292/251.5 |
| 2018/0080245 | A1 * | 3/2018 | Martin | E05B 63/0056 | |
| 2020/0308874 | A1 * | 10/2020 | Kumar | E05B 9/02 | |
| 2020/0354986 | A1 * | 11/2020 | Martin | E05B 17/2049 | |
| 2022/0056737 | A1 * | 2/2022 | Ramakrishna | E05C 1/163 | |

* cited by examiner

LENGTH ADJUSTABLE DOOR LOCK

BACKGROUND OF THE PRESENT INVENTION

Field of Invention

The present invention relates to a length adjustable door lock, and in particular, to a door lock capable of changing the assembling length thereof to fit the specifications of the door.

Description of Related Arts

It should be noted that a door lock mainly has to be correspondingly and matchingly assembled in a door sheet. However, since the specifications and thickness of a door sheet may vary based on the actual needs, a door lock has to have the structure that matches door sheets of different specifications at the same time so as to enhance the serviceability of the door lock. More specifically, the structure of a door lock has to allow length adjustment thereof so as for being utilized in door sheets of different thickness. For instance, conventional technologies, such as Taiwan Pat. App. Nos. 83209999, 093205187, 83216250, and 86209818, disclosed relative structures for adjusting the length of a door lock. Unfortunately, those disclosed structures are difficult and complicated in not only manufacturing, but also in assembling. Hence, there are still drawbacks for locks for door that are length adjustable regarding complicated structure, difficult assembling, and etc.

SUMMARY OF THE PRESENT INVENTION

Hence, an object of the present invention is to provide a length adjustable door lock that is easy to be assembled.

Accordingly, the present invention provides a length adjustable door lock, which include a latch assembly, a lock core connected with the latch assembly, a lock bolt connected with the lock core, and a housing sleeved on the lock bolt, wherein the latch assembly has a latch assembly shell, wherein the latch assembly shell has an assembling opening, adapted for assembling the lock core, and an embedding opening arranged on a side of the assembling opening arranged thereon, wherein the embedding opening has a first embedding portion, a second embedding portion parallel to the first embedding portion, and a communicating portion communicated with the first embedding portion and the second embedding portion provided thereon, wherein the lock core has a joint, adapted for assembled in the assembling opening, wherein the joint has a first embedding slot, a second embedding slot, and a communicating slot arranged thereon correspondingly matching with the first embedding portion, the second embedding portion, and the communicating portion respectively, wherein the lock bolt has a bolt portion and a buckling portion extended from the bolt portion, wherein the buckling portion has a first buckling rib and a connecting rib arranged thereon, wherein the first buckling rib and the connecting rib are adapted for being inserted and embedded into the first embedding slot and the communicating slot through the first embedding portion and the communicating portion respectively, wherein the first buckling rib is adapted for being inserted and embedded into the second embedding slot through the second embedding portion alternatively, wherein the housing has a sleeve sleeved on the outer side of the bolt portion, wherein the bolt portion is allowed to slide relatively with the sleeve.

When the door lock is to be assembled on a door of different specifications, the length of the door lock may be correspondingly adjusted. It only has to have the first buckling rib be correspondingly assembled in the second embedding slot; the length of the door lock can be changed easily. Because the linking and connecting structures between the lock core and the lock bolt of the door lock are relatively simple. Whether the length of the door lock has to be adjusted, the assembling operations of the lock are both easy and convenient.

Still further objects and advantages will become apparent from a consideration of the ensuing description and drawings.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
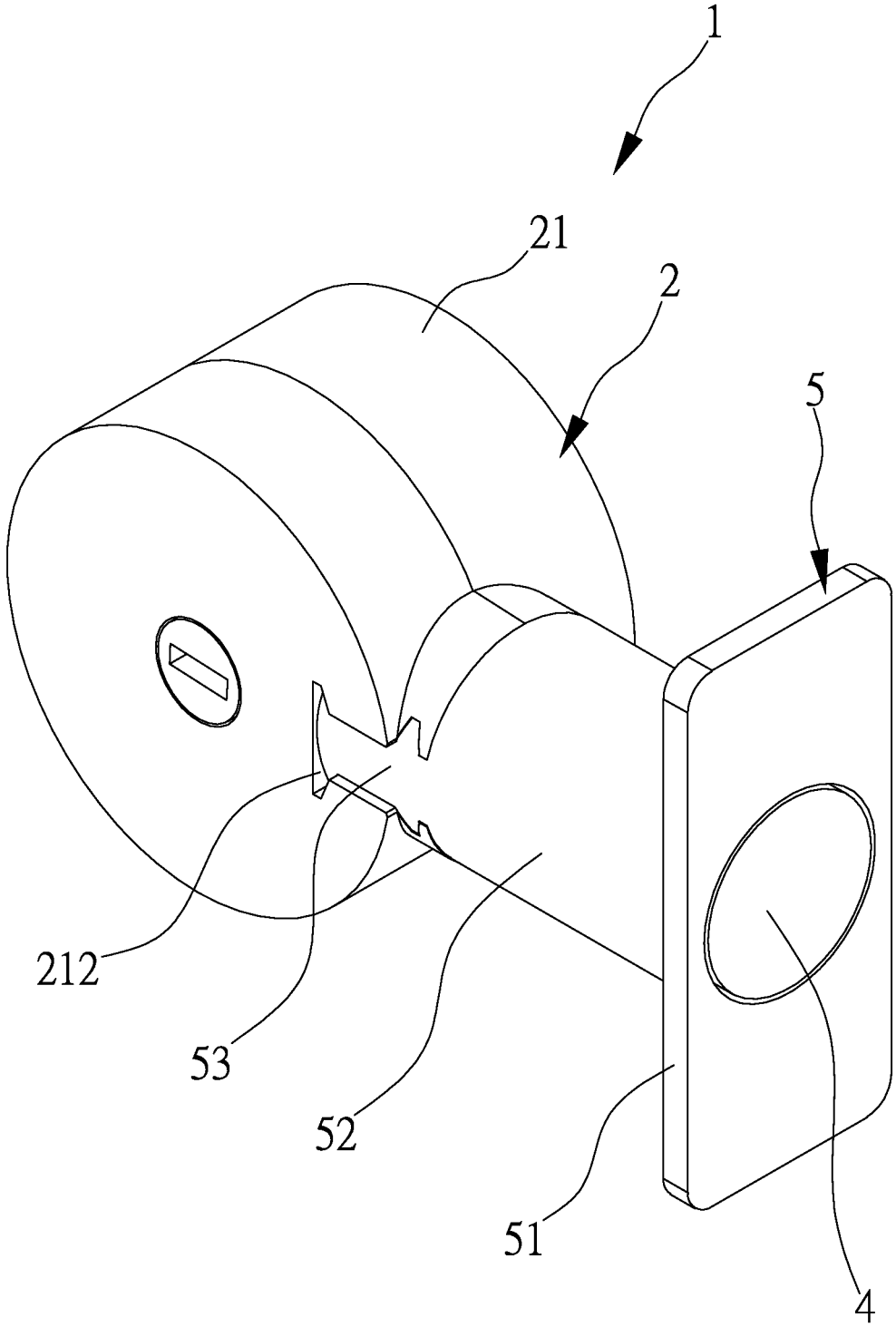
FIG. 1 is a perspective view of a length adjustable door lock according to a preferred embodiment of the present invention.
Figure 2:
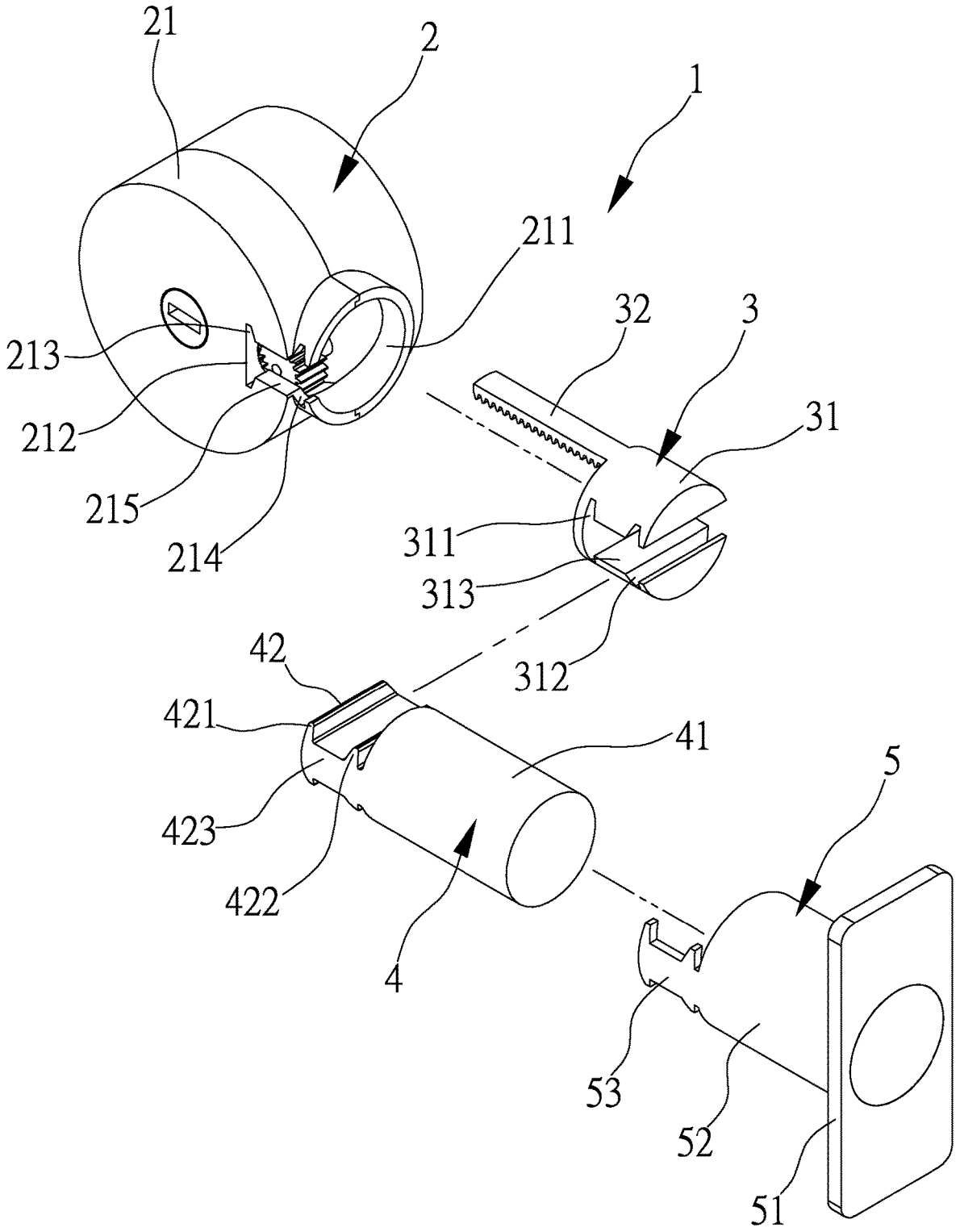
FIG. 2 is an exploded view of the length adjustable door lock according to the above preferred embodiment of the present invention.
Figure 3:
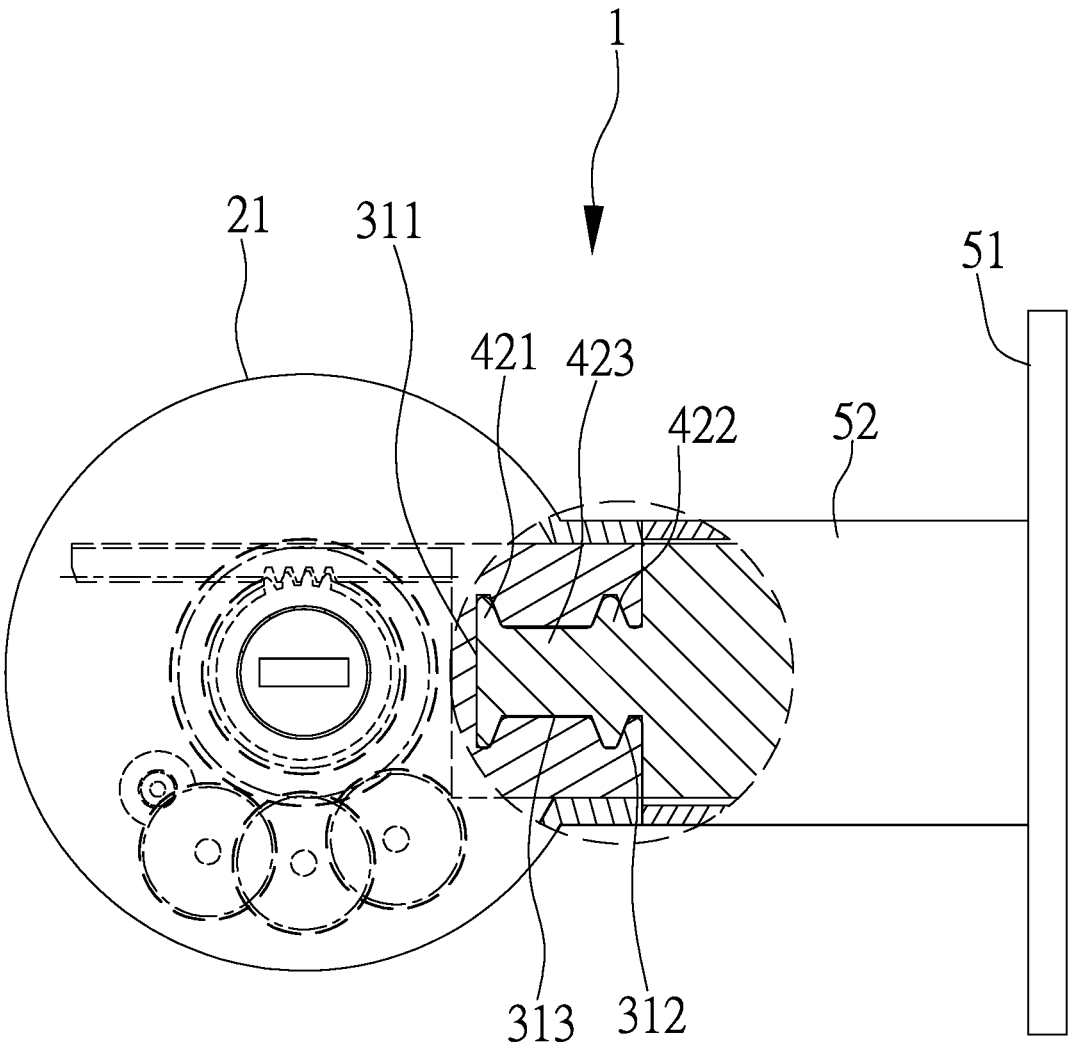
FIG. 3 is a partially sectional side view of the length adjustable door lock according to the above preferred embodiment of the present invention.

Referring to FIGS. 1-3, a length adjustable door lock 1 according to a preferred embodiment of the present invention comprises a latch assembly 2, a lock core 3 connected with the latch assembly 2, a lock bolt 4 connected with the lock core 3, and a housing 5 sleeved on the outside of the lock bolt 4. The latch assembly 2 has a latch assembly shell 21 and a conventional internal configuration configured in the latch assembly shell 21. The internal configuration arranged in the latch assembly shell 21 are not the new features of the present invention, which details would therefore not be further introduced here. The latch assembly shell 21 forms an assembling opening 211 adapted for assembling the lock core 3 and an embedding opening 212 arranged on a side of the assembling opening 211 and communicated with the assembling opening 211. The embedding opening 212 further has a first embedding portion 213, a second embedding portion 214 parallel to the first embedding portion 213, and a communicating portion 215 communicated with the first embedding portion 213 and the second embedding portion 214 provided thereon. The communicating portion 215 is arranged between the first embedding portion 213 and the second embedding portion 214 so as to form the embedding opening 212 an "H" shape in an overall manner. The lock core 3 has a joint 31 adapted for being assembled in the assembling opening 211 and a gear rack 32 extended from the joint 31. The joint 31 has a first embedding slot 311, a second embedding slot 312, and a communicating slot 313 arranged thereon correspondingly matching with the first embedding portion 213, the second embedding portion 214, and the communicating portion 215 respectively. The gear rack 32 is adapted for being inserted into the latch assembly shell 21 to be connected and linked with other mechanisms of the latch assembly 2. The lock bolt 4 has a bolt portion 41 and a buckling portion 42 extended from the bolt portion 41. The buckling portion 42 has a first buckling rib 421, a second buckling rib 422, and a connecting rib 423 arranged thereon. The first buckling rib 421, the second buckling rib 422, and the connecting rib 423 are adapted for being inserted and embedded into the first embedding slot 311, the second embedding slot 312, and the communicating slot 313 through the first embedding portion 213, the second embedding portion 214, and the communicating portion 215 respectively. The first buckling rib 421 may also be inserted and embedded into the second embedding slot 312 through the second embedding portion 214. The housing 5 has a slab 51, a sleeve 52 extended from the slab 51, and a baffle 53 protrudingly extended from the sleeve 52. The slab 51 is adapted for being assembled on a door (not shown in the figures). The sleeve 52 is sleeved on the outer side of the bolt portion 41 and allows the bolt portion 41 to slide relatively with the sleeve 52. The shape of the baffle 53 matches the embedding opening 212 and is adapted for covering and blocking the embedding opening 212.

When assembling, the joint 31 of the lock core 3 should be firstly assembled in the assembling opening 211 of the latch assembly shell 21. The side of the first embedding slot 311, the communicating slot 313, and the second embedding slot 312 faces the first embedding portion 213, the communicating portion 215, and the second embedding portion 214 of the embedding opening 212 correspondingly. Then, the bolt portion 41 of the lock bolt 4 should be inserted and arranged into the sleeve 52, wherein the buckling portion 42 and the baffle 53 shall be correspondingly overlapped. Finally, the buckling portion 42 should be assembled into the joint 31 from a side direction of the embedding opening 212. Here, the first buckling rib 421, the connecting rib 423, and the second buckling rib 422 are respectively and correspondingly in the first embedding slot 311, the communicating slot 313, and the second embedding slot 312. Meanwhile, the baffle 53 is also embedded in the embedding opening 212. Hence, the assembling of the parts is finished. Here, when the latch assembly 2 is in the process of locking or unlocking, the lock core 3 will be driven to linkingly move the lock bolt 4 axially relatively to the housing 5.

Figure 4:
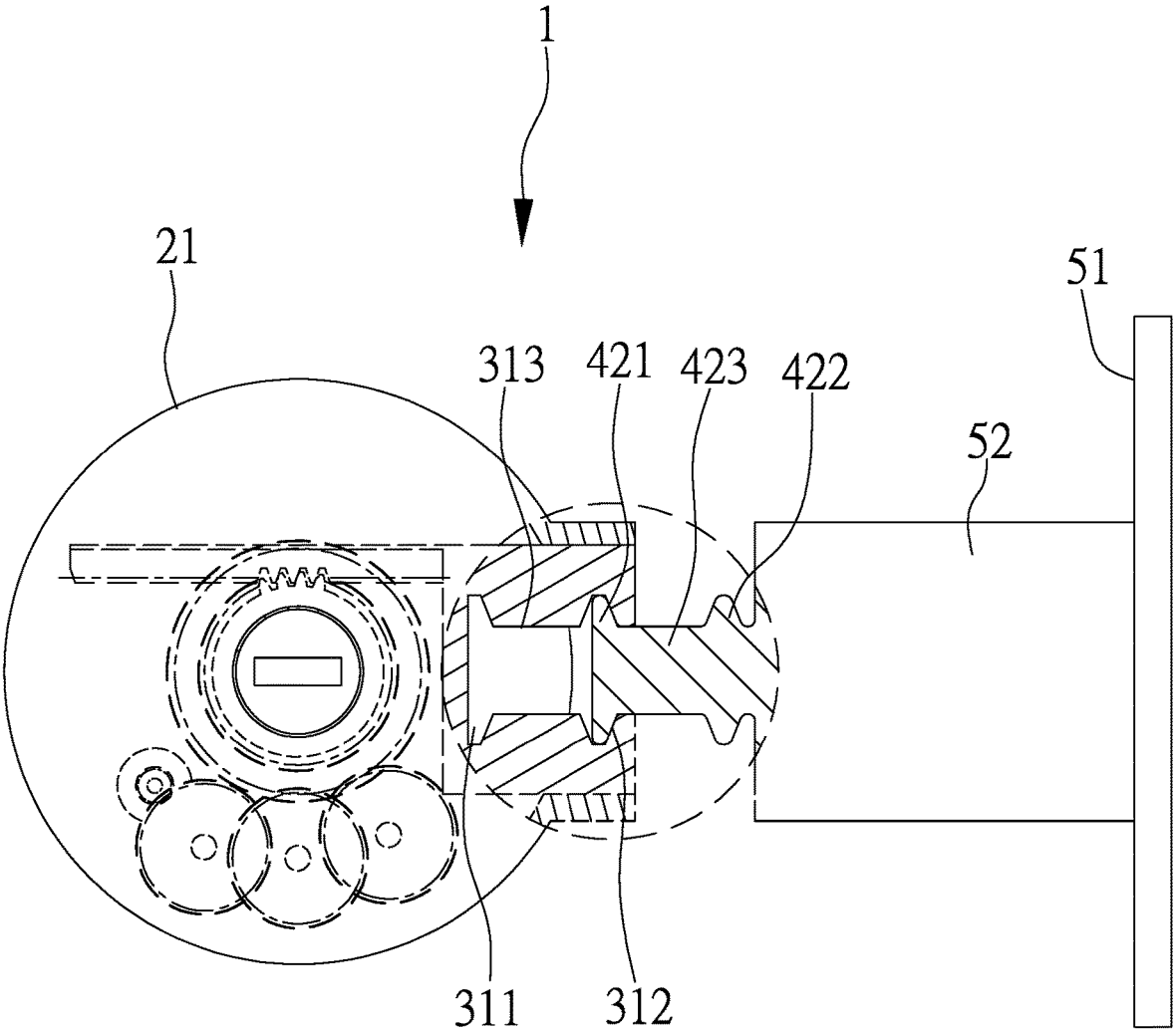
FIG. 4 is a partially sectional side view of the length adjustable door lock changing length thereof according to the above preferred embodiment of the present invention.

When the door lock 1 is to be assembled on a door of different specifications, the length of the length adjustable door lock 1 may be correspondingly adjusted. Referring to FIG. 4, the first buckling rib 421 of the buckling portion 42 may be correspondingly assembled in the second embedding slot 312 so as to change the length of the door lock 1 easily. Therefore, the linking and connecting structures between the lock core 3 and the lock bolt 4 of the door lock 1 are relatively simple. Whether the length of the door lock 1 has to be adjusted, the assembling operations of the lock are both easy and convenient.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A length adjustable door lock, comprising a latch assembly, a lock core connected with said latch assembly, a lock bolt connected with said lock core, and a housing sleeved on said lock bolt, wherein said latch assembly has a latch assembly shell having an assembling opening adapted for assembling said lock core and an embedding opening arranged on a side of said assembling opening arranged thereon, wherein said embedding opening has a first embedding portion, a second embedding portion parallel to said first embedding portion, and a communicating portion communicated with said first embedding portion and said second embedding portion provided thereon, wherein said lock core has a joint, adapted for assembled in said assembling opening, wherein said joint has a first embedding slot, a second embedding slot, and a communicating slot arranged thereon correspondingly matching with said first embedding portion, said second embedding portion, and said communicating portion respectively, wherein said lock bolt has a bolt portion and a buckling portion extended from said bolt portion, wherein said buckling portion has a first buckling rib and a connecting rib arranged thereon, wherein said first buckling rib and said connecting rib are configured to be inserted and embedded into said first embedding slot and said communicating slot through said first embedding portion and said communicating portion respectively, wherein said first buckling rib is configured to be inserted and embedded into said second embedding slot through said second embedding portion alternatively, wherein said housing has a sleeve sleeved on the outer side of said bolt portion, wherein said bolt portion is allowed to slide relatively with said sleeve.

2. The length adjustable door lock, as recited in claim 1, wherein said buckling portion further provides a second buckling rib in the manner than when said first buckling rib is embedded into said first embedding slot, said second buckling rib is allowed to be embedded into said second embedding slot through said second embedding portion.

3. The length adjustable door lock, as recited in claim 2, wherein said housing further has a baffle extended from said sleeve and adapted for covering and blocking said embedding opening.

* * * * *